United States Patent [19]

Leyrer

[11] 4,136,437

[45] Jan. 30, 1979

[54] METHOD OF MOUNTING A POTENTIOMETER

[75] Inventor: Lowell J. Leyrer, Costa Mesa, Calif.

[73] Assignee: International Telephone and Telegraph Corporation, New York, N.Y.

[21] Appl. No.: 837,453

[22] Filed: Sep. 28, 1977

[51] Int. Cl.[2] ..... H01C 17/00

[52] U.S. Cl. ..... 29/610 R; 29/613; 338/164; 338/184; 338/228; 338/276

[58] Field of Search ..... 29/610 R, 613; 338/160, 338/162, 163, 164, 184, 199, 228, 256, 257, 276

[56] References Cited

U.S. PATENT DOCUMENTS

| | | | |
|---|---|---|---|
| Re. 19,605 | 6/1935 | Flanzer et al. | 338/184 X |
| 2,922,973 | 1/1960 | Vacha | 338/276 X |
| 3,486,157 | 12/1969 | Cambpell | 338/184 X |
| 3,531,860 | 10/1970 | Paine et al. | 29/610 |

*Primary Examiner*—C. W. Lanham
*Assistant Examiner*—Gene P. Crosby
*Attorney, Agent, or Firm*—A. Donald Stolzy

[57] ABSTRACT

A method of mounting a potentiometer (pot) on a plate, wherein a hollow cylindrical housing appendage of the pot is positioned through a hole in the plate to the other side thereof. The rotatable shaft of the pot then projects to the said other plate side through the appendage. A washer, a jam nut and a seal nut are positioned around the appendage. A compound is then potted in contact with and around the pot housing sealing it to the plate, and around the shaft. The housing on its side of the plate is larger than the hole. However, the shaft is not primed and is therefore rotatable after potting. The plate is primed on both sides prior to potting.

7 Claims, 3 Drawing Figures

METHOD OF MOUNTING A POTENTIOMETER

BACKGROUND OF THE INVENTION

This invention relates to assembly methods, and more particularly to a method of assembling electrical components or the like.

It is often cumbersome and time consuming to mount circuit components.

PRIOR ART STATEMENT

A search was made and the following U.S. patents were cited:

| Patent No. | Issue Date |
|---|---|
| 1,343,472 | June 15, 1920 |
| 2,561,116 | July 17, 1951 |
| 2,914,744 | November 24, 1959 |
| 3,863,194 | January 28, 1975 |

None of the above-listed patents are believed to be pertinent.

SUMMARY OF THE INVENTION

In accordance with the method of assembly of the present invention, the method includes the steps of inserting an annular appendage of a component housing through a hole in a mounting plate from one side thereof, said housing being larger than said hole on the other side of said mounting plate, said housing carrying a component having a rotatable shaft emanating from the interior of said annular appendage; coating at least the shaft side of the plate with a primer, but not the shaft; and potting a volume of a compound around said shaft in contact with and from said mounting plate over a length of said shaft not to exceed the location of the outer end of said shaft.

BRIEF DESCRIPTION OF THE DRAWINGS

In the accompanying drawings which illustrate exemplary embodiments of the present invention.

DESCRIPTION OF THE PREFERRED EMBODIMENTS

Figure 2:
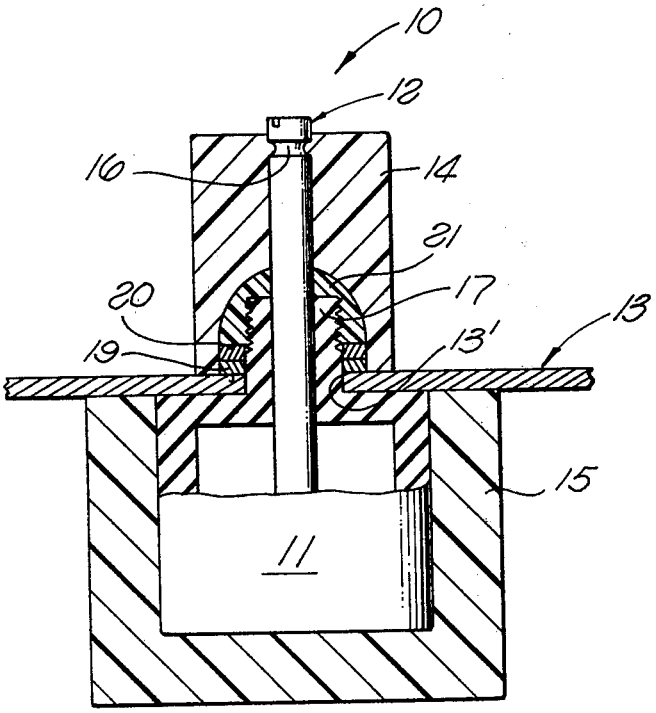
FIG. 2 is a vertical sectional view of the assembly taken on the line 2—2 shown in FIG. 1.

In FIG. 2 a potentiometer 10 is shown having a housing 11 on a rotatable (before and after potting at 14 and 15) shaft 12. Shaft 12 and an annular appendage 17 and the remainder of housing 11 are fixed relative to a mounting plate 13 by means of a washer 19, a jam nut 20 and a seal nut 21. Mounting plate 13 is made of, for example, metal.

In the assembly of pot 10 to mounting plate 13, annular appendage 17 is placed through plate hole 13 as shown. Washer 19 is placed over appendage 17. Jam nut 20 and seal nut 21 are then threaded to and tightened down upon appendage 17. All parts are primed except shaft 12. Portions 15 and 14 are then potted in that order to the assembly as shown in FIG. 2.

Figure 1:
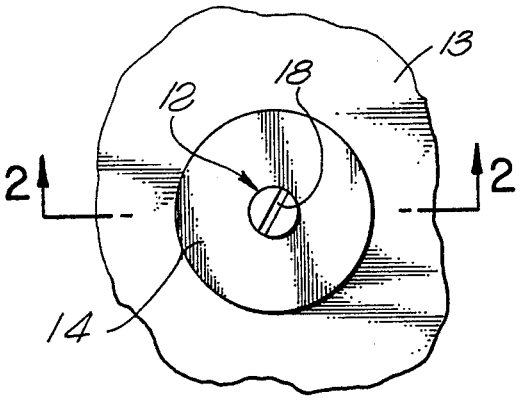
FIG. 1 is a broken-away top plan view of the complete assembly of the present invention.

Mounting plate 13, shaft 12, and a screwdriver slot 18 in shaft 12 are shown in FIG. 1.

Figure 3:
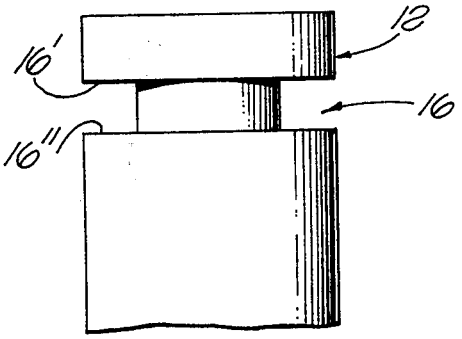
FIG. 3 is an enlarged broken-away elevational view of a potentiometer shaft shown in FIGS. 1 and 2.

The potting compound at 14 fits in a groove 16 between shoulders 16' and 16'' as shown in FIG. 3.

The material of the potting compound at 14 sticks to mounting plate 13, washer 19, jam nut 20 and seal nut 21.

Potting compound 15 sticks to housing 11 and mounting plate 13.

The primer is a thin coating of the potting compound. Any conventional potting compound may be employed.

Seal nut 21 is elastic and has an interference fit with shaft 12.

What is claimed is:

1. The method of assembly, said method comprising the steps of: inserting an annular appendage of a component housing through a hole in a mounting plate from one side thereof, said housing having a portion larger than said hole on the other side of said mounting plate, said housing carrying a component having a rotatable shaft emanating from the interior of said annular appendage; holding said housing portion and said mounting plate in positions relative to each other abutting each other; coating at least the shaft side of the plate with a primer, but not the shaft; and potting a volume of a compound around said shaft in contact with and from said mounting plate over a length of said shaft not to exceed the location of the outer end of said shaft while said housing portion and said plate are held in abutting relation as aforesaid, said primer bonding said compound to said plate.

2. The method as defined in claim 1, wherein said shaft has a pair of shoulders to lock the same in a fixed axial, but rotatable, angular position relative to said potted compound.

3. The method as defined in claim 2, wherein said housing, on the other side of said mounting plate, is also potted in a compound.

4. The method as defined in claim 1, wherein said housing, on the other side of said mounting plate, is also potted in a compound.

5. The method as defined in claim 1, wherein an annular elastic seal is snugly fitted around said shaft before it is potted, and said seal and said shaft are both encompassed by said potted compound.

6. The method of assembly, said method comprising the steps of: coating one side of a mounting plate with a primer, said plate having a hole therethrough; inserting an annular appendage of a component housing through said hole from the other side of said plate, said housing having a portion larger than said hole on said other side of said mounting plate, said housing carrying a component having a rotatable shaft emanating from the interior of said annular appendage; holding said housing portion in abutting relation with said other plate side; and potting a volume of a compound around said shaft in contact with and from said mounting plate over a length of said shaft not to exceed the location of the outer end of said shaft while said housing portion and said plate are held in abutting relation as aforesaid, said primer bonding said compound to said plate.

7. The method of assembly, said method comprising the steps of: coating one side of a mounting plate with a primer, said plate having a hole therethrough; inserting an annular appendage of a component housing through said hole from the other side of said plate, said housing having a portion larger than said hole on said other side of said mounting plate, said housing carrying a component having a rotatable shaft emanating from the interior of said annular appendage; applying a fastener to said appendage on said one plate side in a manner to engage said one plate side and to secure said housing portion in a fixed position relative to said plate in abutment with said other side thereof; coating said fastener with said primer; and potting a volume of a compound around said shaft in contact with and from said mounting plate over a length of said shaft not to exceed the location of the outer end of said shaft while said housing portion and said plate are held in abutting relation as aforesaid, said primer bonding said compound to said plate and said fastener.

* * * * *